US009114615B2

(12) United States Patent
Takagi

(10) Patent No.: US 9,114,615 B2
(45) Date of Patent: Aug. 25, 2015

(54) DISCHARGING ELEMENT SUBSTRATE, PRINTHEAD, AND PRINTING APPARATUS

(71) Applicant: CANON KABUSHIKI KAISHA, Tokyo (JP)

(72) Inventor: Makoto Takagi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/560,432

(22) Filed: Dec. 4, 2014

(65) Prior Publication Data

US 2015/0165766 A1 Jun. 18, 2015

(30) Foreign Application Priority Data

Dec. 12, 2013 (JP) ..... 2013-257396

(51) Int. Cl.
*B41J 2/15* (2006.01)
*B41J 2/14* (2006.01)

(52) U.S. Cl.
CPC ..... *B41J 2/1433* (2013.01)

(58) Field of Classification Search
CPC ..... B41J 2/04541; B41J 2/0458; B41J 2/07; B41J 29/38; B41J 2/0455; B41J 2/04548
See application file for complete search history.

(56) References Cited

U.S. PATENT DOCUMENTS 6,454,377 B1 * 9/2002 Ishizaki ..... 347/15
7,429,093 B2 * 9/2008 Shinkawa ..... 347/19

FOREIGN PATENT DOCUMENTS

JP 2010-155452 A 7/2010

OTHER PUBLICATIONS

U.S. Appl. No. 14/319,073, filed Jun. 30, 2014.

* cited by examiner

*Primary Examiner* — Lamson Nguyen
(74) *Attorney, Agent, or Firm* — Fitzpatrick, Cella, Harper & Scinto

(57) ABSTRACT

A discharging element substrate, comprising a discharging element configured to discharge liquid, a MOS transistor including a drain terminal electrically connected to a first node to which a first voltage is supplied, a gate terminal electrically connected to a second node to which a second voltage is supplied, and a source terminal and a back gate terminal electrically connected to the discharging element, a switch unit arranged in a current path between the discharging element and a ground node, and a unit configured to make a potential difference between the source terminal and the gate terminal lower than the second voltage in a case where the second voltage is not supplied to the second node.

19 Claims, 7 Drawing Sheets

DISCHARGING ELEMENT SUBSTRATE, PRINTHEAD, AND PRINTING APPARATUS

BACKGROUND OF THE INVENTION

1. Field of the Invention

The present invention relates to a discharging element substrate, a printhead, and a printing apparatus.

2. Description of the Related Art

An inkjet printing apparatus includes a printhead which executes printing on a printing medium. The printhead includes a discharging element substrate. The discharging element substrate has a discharging element and a driving transistor for driving the discharging element. The first voltage for energizing the discharging element and the second voltage for controlling the driving transistor are supplied separately. With this arrangement, even if potential fluctuations occur in a power supply node of the first voltage by executing printing, it is possible to reduce an influence on a printing characteristic caused by the potential fluctuations.

When, for example, the printhead is not mounted on the printing apparatus appropriately or a malfunction occurs in the printing apparatus, a situation in which the second voltage out of a plurality of voltages including the above-described first and second voltages is not supplied may occur. A power supply node for supplying the second voltage in this case is indefinite (for example, 0 [V]).

If the voltage of the power supply node supplying the second voltage becomes, for example, 0 [V], an overvoltage may be generated between the source and the gate of the above-described driving transistor. This may cause the insulation breakdown of the driving transistor.

SUMMARY OF THE INVENTION

The present invention provides a technique advantageous in preventing the insulation breakdown of a driving transistor.

One of the aspects of the present invention provides a discharging element substrate, comprising a discharging element configured to discharge liquid, a MOS transistor including a drain terminal, a gate terminal, a source terminal and a back gate terminal, the drain terminal being electrically connected to a first node to which a first voltage is supplied, the gate terminal being electrically connected to a second node to which a second voltage is supplied, and the source terminal and the back gate terminal being electrically connected to the discharging element, a switch unit arranged in a current path between the discharging element and a ground node, and a unit configured to make a potential difference between the source terminal and the gate terminal lower than the second voltage in a case where the second voltage is not supplied to the second node.

Further features of the present invention will become apparent from the following description of exemplary embodiments with reference to the attached drawings.

DESCRIPTION OF THE EMBODIMENTS

Example of Arrangement of Printing Apparatus

An example of the arrangement of an inkjet printing apparatus will be described with reference to FIGS. 1A and 1B. The printing apparatus may be, for example, a single-function printer having only a printing function, or a multi-function printer having a plurality of functions such as a printing function, a FAX function, and a scanner function. Furthermore, the printing apparatus can also include a manufacturing apparatus for manufacturing a color filter, an electronic device, an optical device, a microstructure, or the like by a predetermined printing method.

Figure 1A:
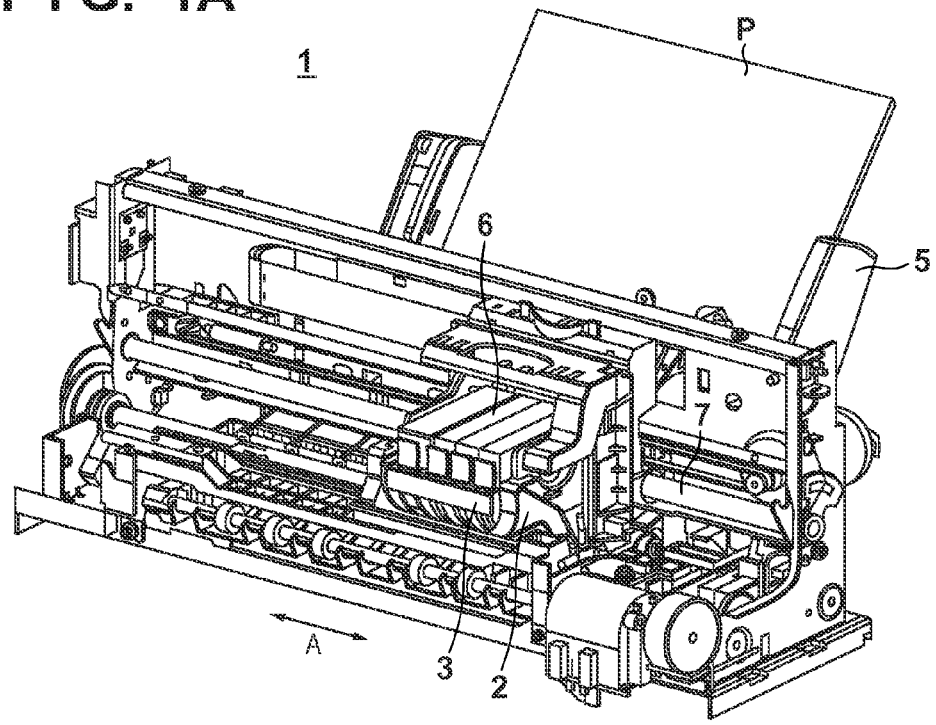
FIGS. 1A and 1B are views for explaining an example of the arrangement of a printing apparatus.

FIG. 1A is a perspective view showing an example of the outer appearance of a printing apparatus PA. In the printing apparatus PA, a printhead 3 for discharging ink to execute printing is mounted on a carriage 2, and the carriage 2 reciprocates in directions indicated by an arrow A to execute printing. The printing apparatus PA feeds a printing medium P such as printing paper via a sheet supply mechanism 5, and conveys it to a printing position. At the printing position, the printing apparatus PA executes printing by discharging ink from the printhead 3 onto the printing medium P.

In addition to the printhead 3, for example, ink cartridges 6 are mounted on the carriage 2. Each ink cartridge 6 stores ink to be supplied to the printhead 3. The ink cartridge 6 is detachable from the carriage 2. The printing apparatus PA is capable of executing color printing. Therefore, four ink cartridges which contain magenta (M), cyan (C), yellow (Y), and black (K) inks are mounted on the carriage 2. These four ink cartridges are independently detachable.

The printhead 3 includes ink orifices (nozzles) for discharging ink, and also includes a discharging element substrate having electrothermal transducers (heaters) corresponding to the nozzles. A pulse voltage corresponding to a print signal is applied to each heater, and heat energy by the heater which has been applied with the pulse voltage generates bubbles in ink, thereby discharging ink from the nozzle corresponding to the heater.

Figure 1B:
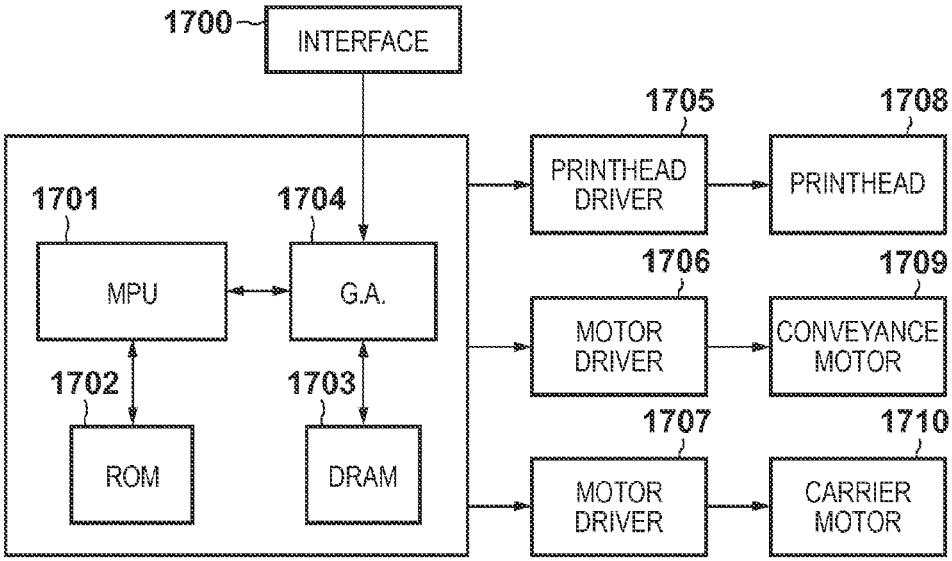

FIG. 1B exemplifies the system arrangement of the printing apparatus PA. The printing apparatus PA includes an interface 1700, an MPU 1701, a ROM 1702, a RAM 1703, and a gate array 1704. The interface 1700 receives a print signal. The ROM 1702 stores a control program to be executed by the MPU 1701. The RAM 1703 saves various data such as the aforementioned print signal, and print data supplied to a printhead 1708. The gate array 1704 controls supply of print data to the printhead 1708, and also controls data transfer between the interface 1700, the MPU 1701, and the RAM 1703.

The printing apparatus PA further includes a printhead driver 1705, motor drivers 1706 and 1707, a conveyance motor 1709, and a carrier motor 1710. The printhead driver 1705 drives the printhead 1708. The motor drivers 1706 and 1707 drive the conveyance motor 1709 and the carrier motor 1710, respectively. The conveyance motor 1709 conveys a printing medium. The carrier motor 1710 conveys the printhead 1708.

When a print signal is input to the interface 1700, it can be converted into print data of a predetermined format between the gate array 1704 and the MPU 1701. Each mechanism performs a desired operation in accordance with the print data, thus executing the above-described printing.

First Embodiment

The first embodiment will be described with reference to FIGS. 2 to 4. Note that in this specification, a "voltage" is described as, unless otherwise specified, a potential difference when using the potential of a ground node as the reference. Also, the "ground node" is typically fixed to 0 [V].

Figure 2:
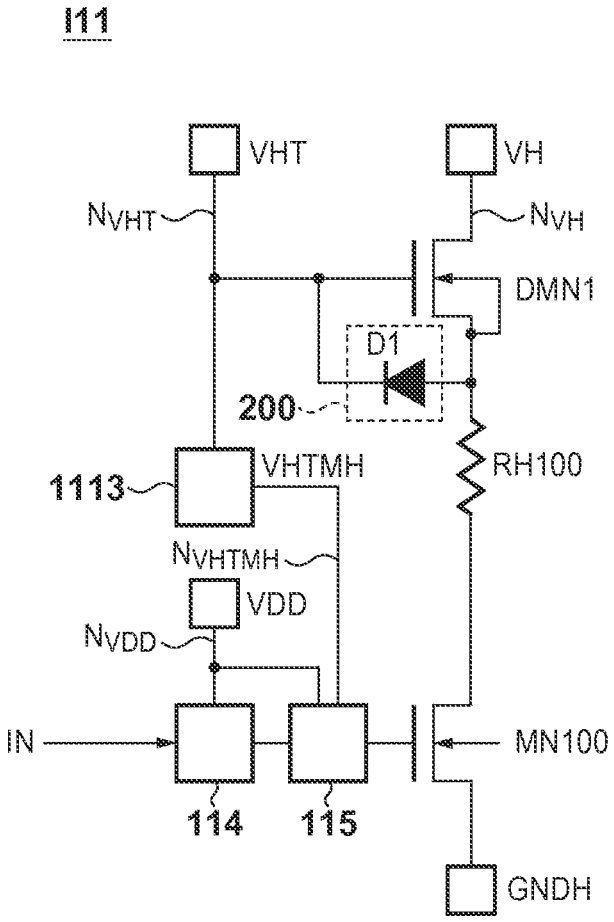
FIG. 2 is a circuit diagram for explaining an example of the arrangement of a discharging element substrate.

FIG. 2 shows an example of the arrangement of a discharging element substrate I11 according to this embodiment. The discharging element substrate I11 includes a heater RH100, an NMOS transistor DMN1, an NMOS transistor MN100, and a unit 200. The discharging element substrate I11 further includes a signal processing unit 114, a level shifter 115, and a voltage generator 1113.

The heater RH100, and the transistors DMN1 and NM 100 are arranged in series so that a current path can be formed between a power supply node $N_{VH}$ which receives a first voltage VH (for example, 24 to 32 [V]) and a ground node (GNDH).

A high-breakdown voltage MOS transistor can be used as the transistor DMN1. The drain terminal of the transistor DMN1 is connected to the power supply node $N_{VH}$. The gate terminal of the transistor DMN1 is connected to a power supply node $N_{VHT}$ which receives a second voltage VHT (for example, 24 to 32 [V]). The source terminal and the back gate terminal of the transistor DMN1 are connected to one terminal of the heater RH100. The voltage VHT is a power supply voltage which is different from the voltage VH, and is hardly susceptible to the potential fluctuations of the voltage VH caused by a print operation. The transistor DMN1 receives this voltage VHT at the gate terminal and performs a source follower operation, thereby supplying a constant current to the heater RH100.

Similarly to the transistor DMN1, the high-breakdown voltage MOS transistor can be used as the transistor MN100. The drain terminal of the transistor MN100 is connected to the other terminal of the heater RH100. The source terminal and the back gate terminal of the transistor MN100 are connected to the ground node. The transistor MN100 is a switch unit which receives a signal from the signal processing unit 114 at the gate terminal via the level shifter 115 and is rendered conductive or non-conductive in response to the signal. The transistor MN100 is rendered conductive, thereby driving (energizing) the heater RH100 and generating heat.

Note that although the arrangement in which the NMOS transistor is used as the transistor MN100 has been exemplified, another known switch unit may be used as the transistor MN100.

As will be described later, the unit 200 is arranged to electrically connect the source terminal to the back gate terminal and the gate terminal of the transistor DMN1.

A third voltage VDD (for example, 3.3 to 5 [V]) serving as a logic power supply voltage is supplied to the signal processing unit 114. The signal processing unit 114 outputs a signal according to print data from the main body of the printing apparatus PA to the transistor MN100 via the level shifter 115.

The voltage generator 1113 generates a fourth voltage VHTMH upon receiving the voltage VHT (or functions as a voltage converter which converts the voltage VHT into the voltage VHTMH), and supplies the voltage VHTMH to the level shifter 115.

Figure 3A:
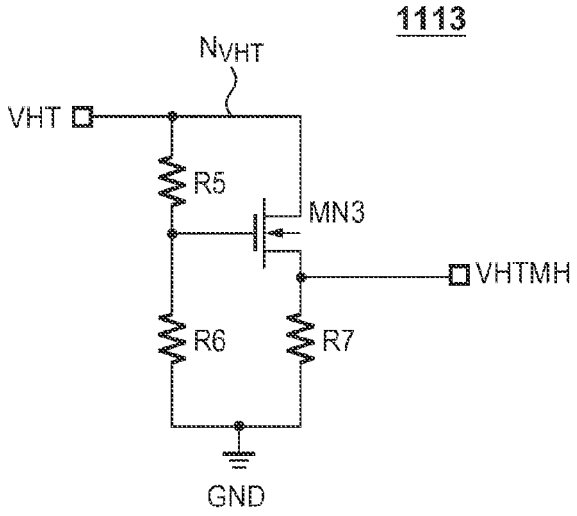
FIGS. 3A and 3B are circuit diagrams for explaining examples of the arrangements of a voltage generator and a level shifter.

FIG. 3A shows an example of the arrangement of the voltage generator 1113. The voltage generator 1113 can be arranged so that resistance elements R5 and R6, and a transistor MN3 and a resistance element R7 form a current path between the power supply node $N_{VHT}$ and the ground node (GND). With this arrangement, a voltage divided by the resistance elements R5 and R6 of the voltage VHT is input to the gate of the transistor MN3, and the voltage VHTMH corresponding to the divided voltage is output.

Note that GNDH as the ground node corresponding to the voltage VH and GND as the ground node corresponding to the voltage VHT can be provided separately as, for example, a noise control measure. As long as another measure is taken, however, GNDH and GND may be the common ground node.

The voltages VDD and VHTMH are supplied to the level shifter 115. The level shifter 115 performs level shift of the signal from the signal processing unit 114 from the potential level of the voltage VDD to the potential level of the voltage VHTMH, and then outputs the resultant signal.

Figure 3B:
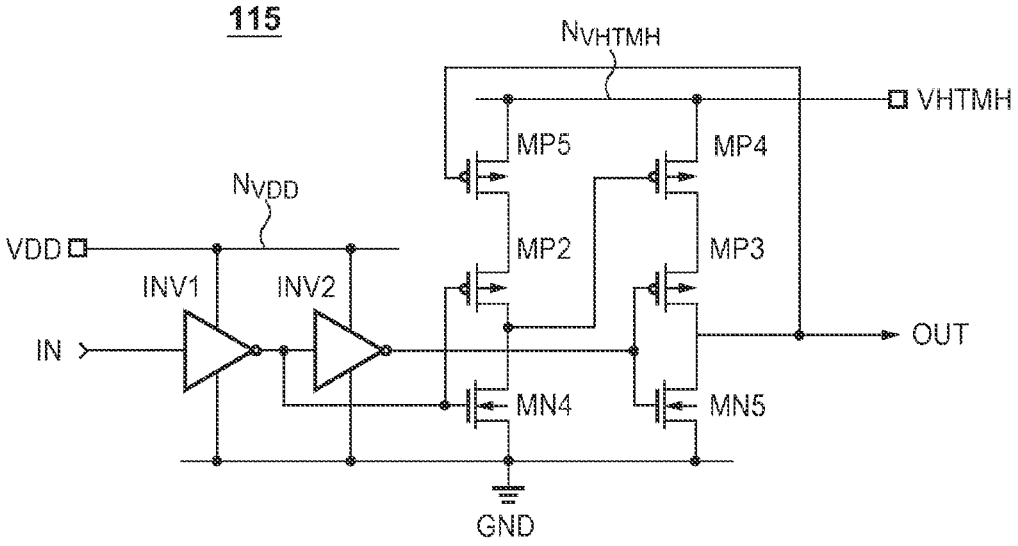

FIG. 3B shows an example of the arrangement of the level shifter 115. The level shifter 115 can be formed using inverters INV1 and INV2, NMOS transistors MN4 and MN5, and PMOS transistors MP2, MP3, MP4, and MP5. The inverter INV1 receives an output from the signal processing unit 114 and outputs it to the inverter INV2. The NMOS transistors MN4 and MN5, and the PMOS transistors MP2 to MP5 form a circuit unit which performs, upon receiving the outputs from the inverters INV1 and INV2, level shift of the potential level of the signal from the signal processing unit 114. More specifically, the transistors MP5, MP2, and MN4 are arranged to form a current path between a power supply node $N_{VHTMH}$ of the voltage VHTMH and the ground node. The transistors MP4, MP3, and MN5 are arranged to form a current path between a power supply node $N_{VHTMH}$ of the voltage VHTMH and the ground node. The gates of the transistors MP2 and MN4 receive the output from the inverter INV1. The gates of the transistors MP3 and MN5 receive the output from the inverter INV2. A node between the transistors MP2 and MN4 is connected to the gate of the transistor MP4. A node between the transistors MP3 and MN5 is connected to the gate of the transistor MP5.

The structure of an n-channel DMOS transistor will be described as an example of the high-breakdown voltage MOS transistor used as the transistor DMN1 with reference to FIG. 4. The structure of the DMOS transistor can be formed using a known semiconductor manufacturing process. An n-type semiconductor region 110 is formed in a substrate including a p-type semiconductor region 111, and a p-type semiconductor region 109 is formed in the n-type semiconductor region 110. A heavily doped p-type region 107*bg* is formed in the p-type semiconductor region 109. A heavily doped n-type region 108*s* is also formed in the p-type semiconductor region 109. A heavily doped n-type region 108*d* is formed at a position away from the p-type semiconductor region 109 in the n-type semiconductor region 110. Insulating films including a field oxide film 106 and a gate insulating film are formed on the substrate. Furthermore, a gate electrode is formed on the field oxide film 106 and the gate insulating film in a boundary region between the p-type semiconductor region 109 and the n-type semiconductor region 110. A terminal 102 corresponds to a source terminal, a terminal 103 corresponds to a drain terminal, a terminal 104 corresponds to a gate terminal, and a terminal 105 corresponds to a back gate terminal (bulk terminal).

This structure reduces the electric field from the n-type region 108*d* corresponding to a drain region to the gate electrode and a channel, and thus the transistor can function as the high-breakdown voltage MOS transistor. This structure also reduces the influence of a substrate bias effect when the source potential of the transistor DMN1 increases by electrically isolating the source and the back gate from the ground node, and then flowing a heater current through the heater RH. Assuming that a threshold voltage of the transistor DMN1 is $V_T$, the source potential of the transistor DMN1 will be about (VHT−$V_T$). A gate-source potential difference is about $V_T$, and thus the insulation breakdown of the gate-source does not occur.

As described above, the source of the transistor DMN1 is in a high potential state of about (VHT−$V_T$) while a current is supplied to the heater RH appropriately. In this state, consider a case in which the voltage VH is supplied to the discharging element substrate I11 appropriately, but the voltage VHT is no longer supplied to the discharging element substrate I11 appropriately. If no voltage VHT is supplied, the potential of the power supply node $N_{VHT}$ enters an indefinite state. When the potential becomes, for example, 0 [V], the gate potential of the transistor DMN1 becomes almost 0 [V]. When the transistor MN100 is in a non-conductive state, the source of the transistor DMN1 is kept in a high potential state. This is because the discharge path of a charge accumulated in the source of the transistor DMN1 does not exist substantially. As a result, a gate-source overvoltage of the transistor DMN1 is generated, thereby causing the insulation breakdown of the gate-source.

Note that when no voltage VHT is supplied, the potential of the power supply node $N_{VHT}$ can typically become equal to the potential of the ground node via the substrate. However, the power supply node $N_{VHT}$ may be pulled down and fixed using, for example, a resistance element having a large resistance value in order to avoid the indefinite state of the potential.

In this embodiment, as the unit 200, for example, a diode D1 is arranged to electrically connect the source terminal and the back gate terminal to the gate terminal of the transistor DMN1. The diode D1 includes an anode connected to the source terminal and the back gate terminal of the transistor DMN1, and a cathode connected to the gate terminal (or the power supply node $N_{VHT}$) of the transistor DMN1.

When a bias higher than a forward voltage is applied to the diode D1, or more specifically, when the potential of the anode exceeds the potential of the cathode by a predetermined value (for example, 0.6 [V]), a forward current flows through the diode D1. Charge transfer caused by this forward current reduces the source potential of the transistor DMN1, thus reducing the gate-source potential difference of the transistor DMN1.

That is, when the potential of the power supply node $N_{VHT}$ falls below the source potential of the transistor DMN1 by a predetermined value, the unit 200 can function as a potential difference adjuster which reduces the gate-source potential difference of the transistor DMN1. The unit 200 reduces a possibility of causing the gate-source insulation breakdown of the transistor DMN1 even if no voltage VHT is supplied appropriately. Hence, this embodiment is advantageous in preventing the insulation breakdown of the driving transistor.

In this embodiment, the case in which one diode D1 is used as the unit 200 has been exemplified. However, a multistage diode made of two or more diodes D1 connected in series may be used based on, for example, the specification of the discharging element substrate I11.

For example, the number of stages and the number of diodes D1 may be determined based on, for example, the breakdown voltage (the voltage that may cause an insulation breakdown) of the transistor DMN1 and the forward voltage of each diode (for example, 0.6 [V]). More specifically, when the number of stages of the diode D1 is n, the gate-source potential difference of the transistor DMN1 can be suppressed to about 0.6×n [V]. Accordingly, the number n of stages may be determined such that 0.6×n [V] does not exceed the above-mentioned breakdown voltage. The source potential of the transistor DMN1 can correspond to the gate potential of the transistor DMN1 and the threshold voltage $V_T$ of the transistor DMN1. The number of diodes D1 may be selected based on the forward voltage of each diode so that the total of the forward voltages becomes higher than the source-gate potential difference of the transistor DMN1.

Note that this embodiment has been described above by exemplifying the arrangement using the diode D1. The present invention, however, is not limited to this arrangement, and need only adopt an arrangement having the similar function. For example, a diode-connected transistor instead of the diode D1 or a bipolar transistor may be used.

Second Embodiment

In the aforementioned first embodiment, the unit 200 arranged to connect the source terminal and the back gate terminal to the gate terminal of the transistor DMN1 has been exemplified. The present invention, however, is not limited to this arrangement, and may adopt another arrangement.

Figure 5:
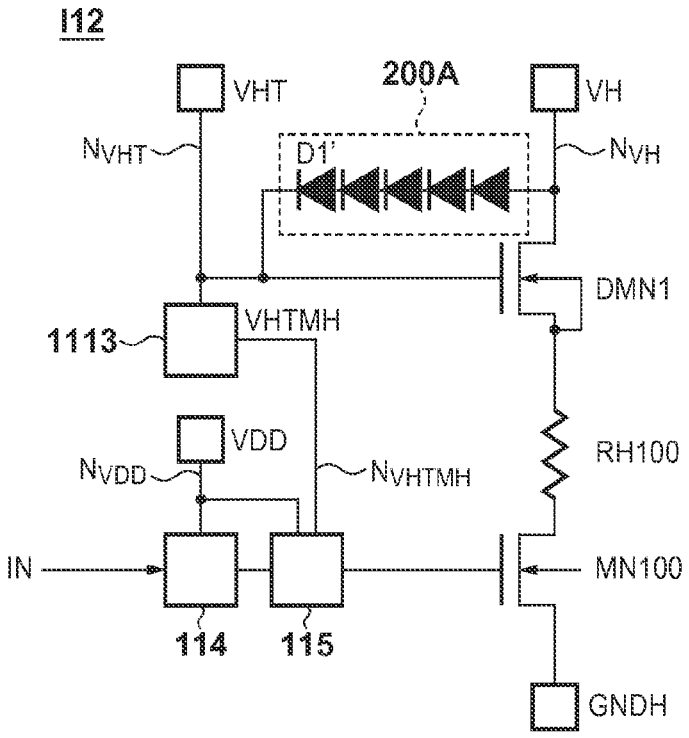
FIG. 5 is a circuit diagram for explaining an example of the arrangement of a discharging element substrate.

FIG. 5 shows an example of the arrangement of a discharging element substrate I12 according to this embodiment. The discharging element substrate I12 includes, instead of a unit 200, a unit 200A arranged to connect the drain terminal to the gate terminal of a transistor DMN1. The unit 200A includes a five-stage diode D1' including five diodes connected in series. The diode D1' includes an anode connected to the drain terminal of the transistor DMN1, and a cathode connected to the gate terminal of the transistor DMN1. Note that although the number of stages of the diode D1' is set to n=5, this number n of stages may be determined appropriately based on, for example, the specification of the discharging element substrate I12, as described above.

The number n of stages can also be determined based on, for example, the potential fluctuation amount of a power supply node $N_{VH}$ in a print operation by a printing apparatus PA. When, for example, the potential fluctuation amount of the power supply node $N_{VH}$ is expected to be larger than 1 [V] in an arrangement using a power supply voltage corresponding to equal voltage values of voltages VH and VHT, the number n of stages may be larger than two. This makes it possible to prevent the above-described insulation breakdown while reducing the influence on a power supply node $N_{VHT}$ caused by the potential fluctuations of the power supply node $N_{VH}$ in the print operation. Also, in an arrangement using a power supply voltage satisfying, for example, VH>VHT, the number n of stages may be determined such that 0.6×n [V] exceeds (VH−VHT).

In this embodiment, the number n of stages=5. Therefore, when the gate-drain potential difference of the transistor DMN1 is larger than 0.6×5=3 [V], a forward current flows from the power supply node $N_{VH}$ to the power supply node $N_{VHT}$. This increases the gate potential of the transistor DMN1, thus reducing the gate-source potential difference. In this embodiment, therefore, it is also possible to obtain the same effects as those in the first embodiment.

Third Embodiment

In the aforementioned first and the second embodiments, the arrangements using the unit 200 and the unit 200A each including at least one diode has been exemplified. The present invention, however, is not limited to these arrangements, and may adopt another arrangement.

Figure 6:
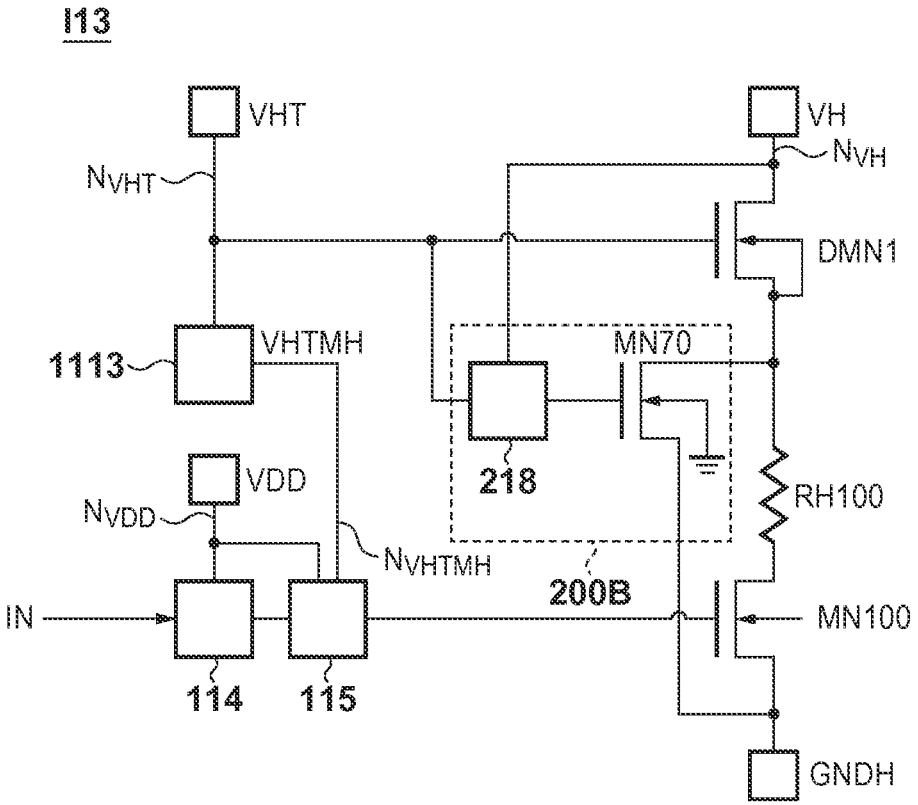
FIG. 6 is a circuit diagram for explaining an example of the arrangement of a discharging element substrate.

FIG. 6 shows an example of the arrangement of a discharging element substrate I13 according to this embodiment. The discharging element substrate I13 includes a unit 200B including a detecting unit 218 and an NMOS transistor MN70.

The detecting unit 218 detects the potential of a power supply node $N_{VHT}$. More specifically, the detecting unit 218 monitors a voltage VHT upon receiving a voltage VH. The detecting unit 218 outputs a detection result to the transistor MN70.

The aforementioned high-breakdown voltage MOS transistor can be used as the transistor MN70. The drain terminal of the transistor MN70 is connected to a node between a transistor DMN1 and a heater RH100, and the source terminal of the transistor MN70 is connected to a ground node (GNDH). The transistor MN70 receives the detection result from the detecting unit 218 at the gate, and is rendered conductive or non-conductive depending on the detection result.

Figure 7:
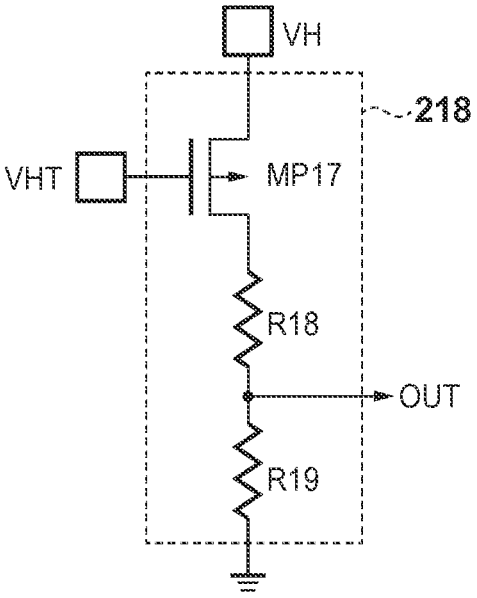
FIG. 7 is a circuit diagram for explaining an example of the arrangement of a detecting unit.

FIG. 7 shows an example of the arrangement of the detecting unit 218. The detecting unit 218 includes a PMOS transistor MP17, and resistance elements R18 and R19. The transistor MP17, and the resistance elements R18 and R19 are arranged in series so that a current path can be formed. More specifically, the transistor MP17 includes a drain terminal connected to a power supply node $N_{VH}$, and a source terminal connected to one terminal of the resistance element R18. The other terminal of the resistance element R18 is connected to one terminal of the resistance element R19. The other terminal of the resistance element R19 is connected to the ground node (GNDH).

The gate terminal of the transistor MP17 is connected to the power supply node $N_{VHT}$. When the voltage VHT is supplied, the transistor MP17 is rendered non-conductive, and the detecting unit 218 outputs Low level. The aforementioned transistor MN70 is rendered non-conductive upon receiving the Low level.

On the other hand, when no voltage VHT is supplied, the transistor MP17 is rendered conductive, and the detecting unit 218 outputs a voltage divided by the resistance elements R18 and R19. The transistor MN70 is rendered conductive upon receiving the divided voltage. This reduces the source potential of the transistor DMN1, thus reducing the gate-source potential difference of the transistor DMN1.

An overvoltage can also be applied to the gate insulating film of the transistor MP17. Therefore, the high-breakdown voltage MOS transistor such as a PMOS transistor whose thickness of a gate insulating film is sufficiently large can be used as the transistor MP17. To reduce a manufacturing cost, for example, a field oxide film 106 used when forming the transistor DMN1 or an interlayer insulating film may be used as the gate insulating film.

As described above, in this embodiment, it is also possible to obtain the same effects as those in the first embodiment.

Fourth Embodiment

Figure 8:
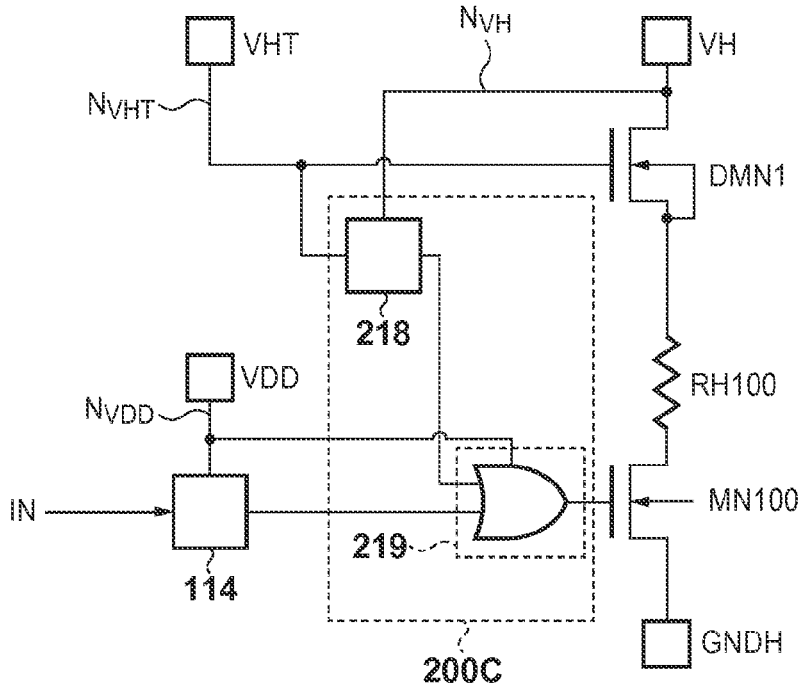
FIG. 8 is a circuit diagram for explaining an example of the circuit arrangement of a discharging element substrate.

FIG. 8 shows an example of the arrangement of a discharging element substrate I14 according to this embodiment. The discharging element substrate I14 includes a unit 200C including a detecting unit 218 and an OR circuit 219. A voltage VDD is supplied to the OR circuit 219. The OR circuit 219 receives a signal from a signal processing unit 114 and a signal from the detecting unit 218, and outputs the result to a transistor MN100.

When a voltage VHT is supplied, a transistor MP17 in the detecting unit 218 is rendered non-conductive, and the detecting unit 218 outputs Low level. The OR circuit 219 outputs the signal from the signal processing unit 114, and a print operation based on the signal is performed appropriately.

On the other hand, when no voltage VHT is supplied, the transistor MP17 in the detecting unit 218 is rendered conductive, and the detecting unit 218 outputs a voltage divided by resistance elements R18 and R19. The OR circuit 219 which has received the divided voltage outputs Hi level, and the transistor MN100 is rendered conductive. This reduces the source potential of a transistor DMN1, thus reducing the gate-source potential difference of the transistor DMN1.

In this embodiment, the arrangement of the unit 200C including the detecting unit 218 and the OR circuit 219 has been exemplified. However, the present invention may adopt an arrangement in which another OR circuit is combined instead of the OR circuit 219, or a control unit which controls the transistor MN100 upon receiving the detection result from the detecting unit 218 may be provided.

In this embodiment, a level shifter 115 is not used. The present invention, however, can adopt an arrangement using the level shifter 115 as needed in this embodiment, needless to say, and is not limited to this arrangement. For example, in the aforementioned first embodiment, since the potential of the ground node (GNDH) may fluctuate in the print operation, the arrangement in which the transistor MN100 receives the signal from the signal processing unit 114 at the gate terminal via the level shifter 115 has been adopted. However, it is also possible to adopt the arrangement using no level shifter 115 as in this embodiment by, for example, increasing the width of a power supply wiring pattern for grounding and reducing a wiring resistance sufficiently.

Fifth Embodiment

In the aforementioned first to fourth embodiments, a mode of reducing the gate-source potential difference of the transistor DMN1 using the unit 200 or the like when no voltage VHT is supplied has been described. However, a case in which while the voltage VHT is supplied to the discharging element substrate appropriately, no voltage VH is supplied is also possible. As an arrangement which can also cope with this case, a discharging element substrate according to this embodiment will be described with reference to FIG. 9.

Figure 9:
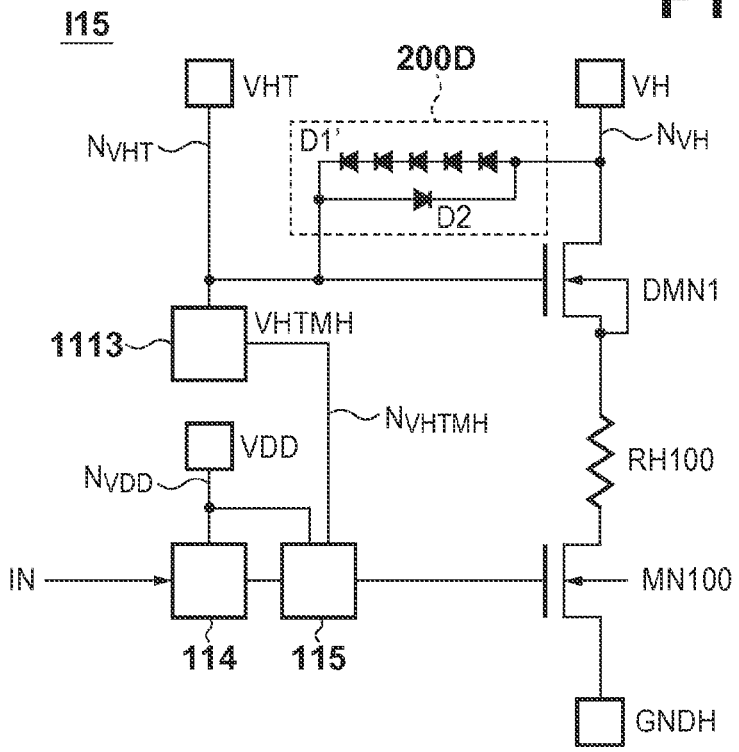
FIG. 9 is a circuit diagram for explaining an example of the circuit arrangement of a discharging element substrate.

FIG. 9 shows an example of the arrangement of a discharging element substrate I15 according to this embodiment. The discharging element substrate I15 is different from the discharging element substrate I12 according to the second embodiment (see FIG. 5) in that it includes a unit 200D having a bi-directional diode. The unit 200D further includes a second diode D2 in addition to a five-stage diode D1' (same as that in the second embodiment), and the diodes D1' and D2 form the bi-directional diode.

The diode D2 includes an anode connected to the gate terminal of a transistor DMN1, and a cathode connected to the drain terminal of the transistor DMN1.

When, for example, no voltage VH is supplied, the potential of a power supply node $N_{VH}$ is setting an indefinite state (for example, 0 [V]). As a consequence, the drain potential of the transistor DMN1 becomes indefinite. When, for example, the drain potential is 0 [V], the channel potential and the source potential can also become 0 [V]. On the other hand, since a voltage VHT is supplied to the gate of the transistor DMN1, an overvoltage may be generated between the gate-source substrate of the drive transistor, thereby causing an insulation breakdown.

When a bias higher than a forward voltage is applied to the diode D2 of the unit 200D, a forward current flows through the diode D2. This forward current increases the potential of the power supply node $N_{VH}$ (that is, increases the drain potential of the transistor DMN1), thus reducing the gate-source potential difference of the transistor DMN1.

Therefore, this embodiment is advantageous in preventing the insulation breakdown of the driving transistor even when no voltage VH is supplied, in addition to the same effects as those in the aforementioned first embodiment.

In this embodiment, the five-stage diode D1' (including an anode on the side of $N_{VH}$ and a cathode on the side of $N_{VHT}$) and the one-stage diode D2 (including an anode on the side of $N_{VHT}$ and a cathode on the side of $N_{VH}$) have been exemplified as the bi-directional diode. However, the number of these stages may be determined appropriately based on, for example, the specification of the discharging element substrate 115 as described above (as in the first and the second embodiments). The number of these stages may be determined based on, for example, a magnitude relationship between the power supply voltages VH and VHT that should be supplied. More specifically, assuming that the number of stages of the diode D1' is n1 and that of the diode D2 is n2, n1=n2 may be established. In an arrangement using a power supply voltage satisfying VH>VHT, n1>n2 may be established. Also, in an arrangement using a power supply voltage satisfying VH<VHT, n1<n2 may be established.

In this embodiment, the arrangement in which the diode D2 includes an anode connected to the gate terminal of the transistor DMN1, and a cathode connected to the drain terminal of the transistor DMN1 has also been exemplified. The present invention, however, is not limited to this arrangement. The cathode of the diode D2 may be connected to the source terminal and the back gate terminal of the transistor DMN1, and the diode D2 may be applied to another embodiment.

(Application)

In each embodiment described above, one heater RH100, one transistor DMN1 corresponding to the heater RH100, and one transistor MN100 for energizing the heater RH100 have been shown for descriptive convenience. In practice, however, a print operation can be performed by driving a plurality of heaters according to a predetermined driving method (for example, a time-divisional driving method).

Figure 4:
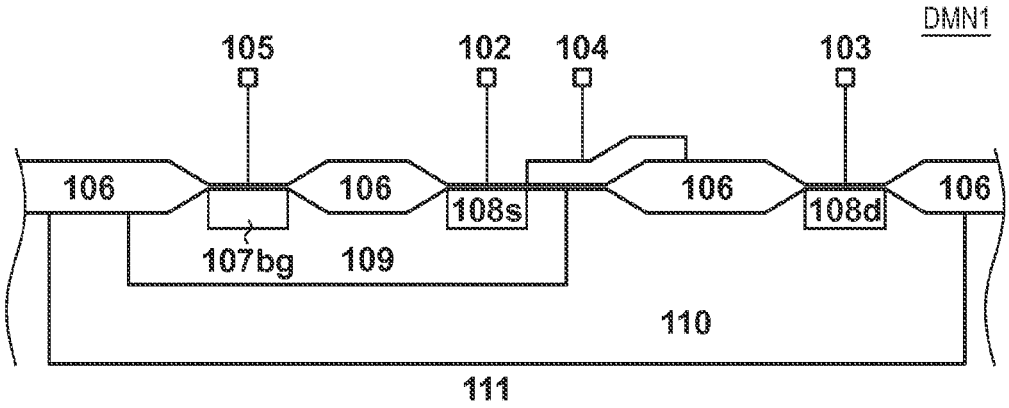
FIG. 4 is a view for explaining an example of the structure of a high-breakdown voltage MOS transistor.
Figure 10:
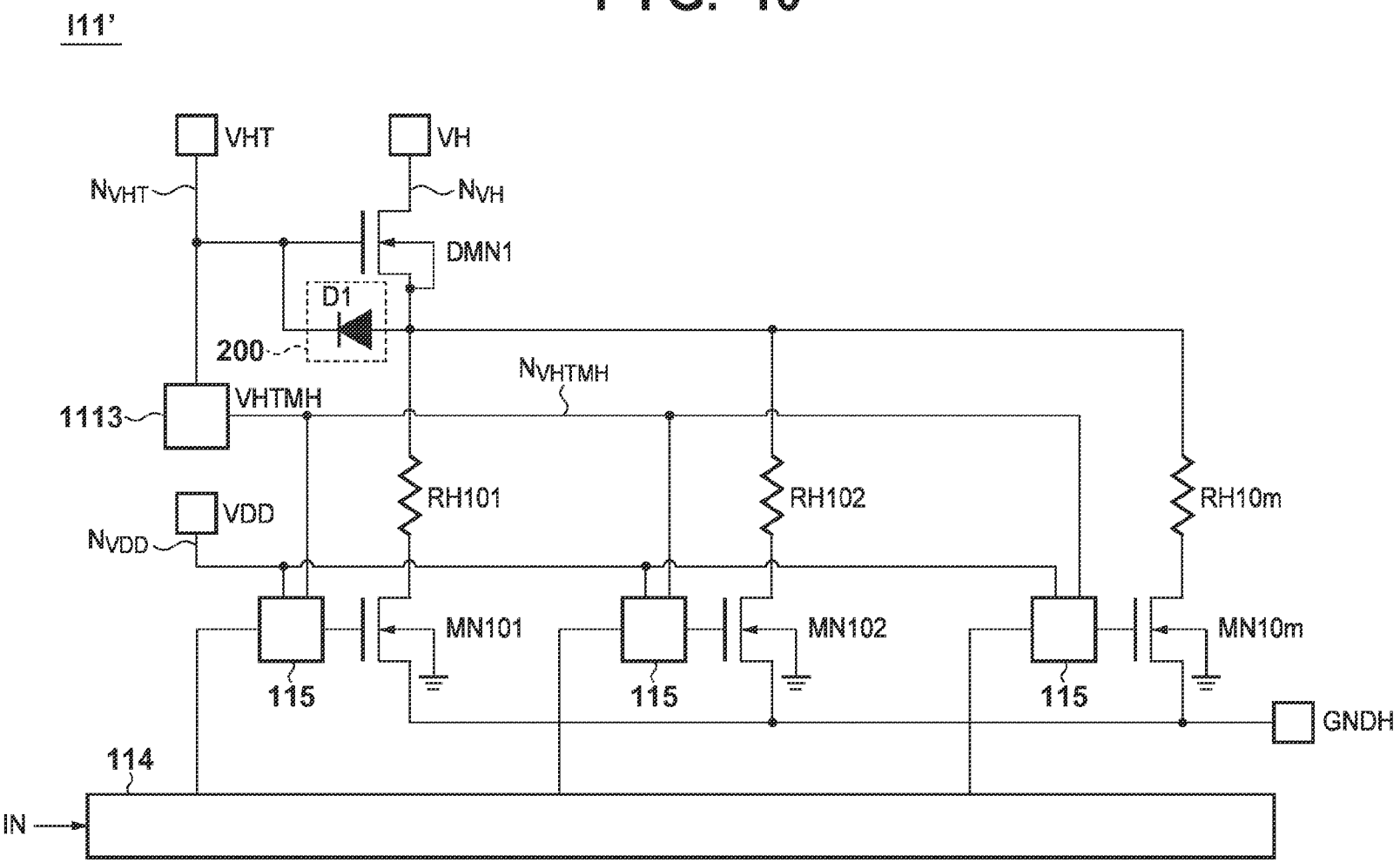
FIG. 10 is a circuit diagram for explaining an example of the circuit arrangement of a discharging element substrate.

FIG. 10 shows an example of the arrangement of a discharging element substrate I11' on which m heaters RH101 to RH10*m* are arrayed based on the arrangement described in the first embodiment (see FIG. 4). The discharging element substrate I11' includes, in addition to the heaters RH101 to RH10*m*, a transistor DMN1, and m transistors MN101 to MN10*m* which are arranged to correspond to the heaters RH101 to RH10*m* and configured to drive the corresponding heaters. The source terminal of the transistor DMN1 is commonly connected to one-terminal sides of each of the heaters RH101 to RH10*m*. The transistor DMN1 performs a source follower operation, thereby supplying a constant current to any one of the heaters RH101 to RH10*m*. This arrangement drives any one of the heaters RH101 to RH10*m*.

The aforementioned unit 200 is arranged to electrically connect the source terminal and the back gate terminal to the gate terminal of the transistor DMN1.

Assume that the above-described group including the heaters RH101 to RH10*m* and one transistor DMN1 is one unit. When forming two or more groups, the discharging element substrate may be formed in a similar manner. That is, in each group, the unit 200 is arranged to electrically connect the source terminal and the back gate terminal to the gate terminal of the transistor DMN1.

Others

Although some preferred embodiments have been described above, the present invention is not limited to them. The embodiments can be changed in accordance with, for example, the specification of a discharging element substrate, and the present invention can also be implemented by another embodiment. The respective units (including a functional unit such as a level shifter 115, in addition to a unit 200 or the like) exemplified in each embodiment above may adopt arrangements, for example, each having the same function. The present invention, however, is not limited to these arrangements. In addition, for example, an arrangement using a heater (electrothermal transducer) as a discharging element has been exemplified in each of the above-described embodiments, but a printing method using a piezoelectric element or another known printing method may be adopted. Furthermore, for example, each parameter (a voltage value or the like) can be changed in accordance with the specification, and the arrangement of each unit can be accordingly changed so as to appropriately operate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-257396, filed Dec. 12, 2013, which is hereby incorporated by reference herein in its entirety.

What is claimed is:

1. A discharging element substrate comprising:

a discharging element configured to discharge liquid;

a MOS transistor including a drain terminal, a gate terminal, a source terminal and a back gate terminal, the drain terminal being electrically connected to a first node to which a first voltage is supplied, the gate terminal being electrically connected to a second node to which a second voltage is supplied, and the source terminal and the back gate terminal being electrically connected to the discharging element;

a switch unit arranged in a current path between the discharging element and a ground node; and a unit configured to make a potential difference between the source terminal and the gate terminal lower than the second voltage in a case where the second voltage is not supplied to the second node.

2. The substrate according to claim 1, wherein the MOS transistor performs a source follower operation.

3. The substrate according to claim 1, wherein the switch unit includes a second MOS transistor, a drain terminal of the second MOS transistor is connected to the discharging element, and a source terminal of the second MOS transistor is connected to the ground terminal.

4. The substrate according to claim 1, wherein the unit includes at least one diode, and the at least one diode includes an anode connected to the source terminal of the MOS transistor and to the back gate terminal of the MOS transistor, and includes a cathode connected to the gate terminal of the MOS transistor.

5. The substrate according to claim 4, wherein the unit further includes at least one second diode, and the at least one second diode includes an anode connected to the gate terminal of the MOS transistor and a cathode connected to the source terminal of the MOS transistor and to the back gate terminal of the MOS transistor.

6. The substrate according to claim 5, wherein the number of the at least one diode and the number of the at least one second diode are determined based on a magnitude relationship between the first voltage that should be supplied to the first node and the second voltage that should be supplied to the second node.

7. The substrate according to claim 5, wherein the number of the at least one second diode is larger than the number of the at least one diode.

8. The substrate according to claim 4, wherein the unit further includes at least one second diode, and the at least one second diode includes an anode connected to the gate terminal of the MOS transistor and a cathode connected to the drain terminal of the MOS transistor.

9. The substrate according to claim 1, wherein the unit includes at least one diode, and the at least one diode includes an anode connected to the drain terminal of the MOS transistor and a cathode connected to the gate terminal of the MOS transistor.

10. The substrate according to claim 1, wherein the unit includes:

a detecting unit configured to detect a potential of the second node; and a second switch unit configured to electrically connect the source terminal and the back gate terminal of the MOS transistor to the ground node based on a detection result from the detecting unit.

11. The substrate according to claim 10, wherein each of the MOS transistor and the switch unit is an NMOS transistor, and the detecting unit includes:

a resistance element; and a PMOS transistor including a source terminal connected to the first node, a gate terminal connected to the second node, and a drain terminal connected to the resistance element.

12. The substrate according to claim 1, wherein the unit includes:

a detecting unit configured to detect a potential of the second node; and a control unit configured to set the switch unit to a conductive state based on a detection result from the detecting unit.

13. The substrate according to claim 1, wherein the MOS transistor is made of a DMOS transistor.

14. A printhead comprising:

a discharging element substrate defined in claim 1, and an ink orifice arranged to correspond to the discharging element, and configured to discharge ink in response to a current flowing into the discharging element.

15. A printing apparatus comprising:

a printhead defined in claim 14; and a printhead driver configured to drive the printhead.

16. A discharging element substrate comprising:

a discharging element configured to discharge liquid;

a MOS transistor including a drain terminal, a gate terminal, a source terminal and a back gate terminal, the drain terminal being electrically connected to a first node to which a first voltage is supplied, the gate terminal being electrically connected to a second node to which a second voltage is supplied, and the source terminal and the back gate terminal being electrically connected to the discharging element;

a switch unit arranged in a current path between the discharging element and a ground node; and at least one diode, wherein the at least one diode includes an anode connected to the source terminal of the MOS transistor and to the back gate terminal of the MOS transistor, and a cathode connected to the gate terminal of the MOS transistor.

17. A discharging element substrate comprising:

a discharging element configured to discharge liquid;

a MOS transistor including a drain terminal electrically connected to a first node to which a first voltage is supplied, a gate terminal electrically connected to a second node to which a second voltage is supplied, and a source terminal and a back gate terminal electrically connected to the discharging element;

a switch unit arranged in a current path between the discharging element and a ground node; and at least one diode, wherein the at least one diode includes an anode connected to the drain terminal of the MOS transistor and a cathode connected to the gate terminal of the MOS transistor.

18. A discharging element substrate comprising:

a discharging element configured to discharge liquid;

a MOS transistor including a drain terminal, a gate terminal, a source terminal and a back gate terminal, the drain terminal being electrically connected to a first node to which a first voltage is supplied, the gate terminal being electrically connected to a second node to which a second voltage is supplied, and the source terminal and the back gate terminal being electrically connected to the discharging element;

a switch unit arranged in a current path between the discharging element and a ground node;

a detecting unit configured to detect a potential of the second node, and a second switch unit configured to electrically connect the source terminal and the back gate terminal of the MOS transistor to the ground node based on a detection result from the detecting unit.

19. A discharging element substrate comprising:

a discharging element configured to discharge liquid;

a MOS transistor including a drain terminal, a gate terminal, a source terminal and a back gate terminal, the drain terminal being electrically connected to a first node to which a first voltage is supplied, the gate terminal being electrically connected to a second node to which a second voltage is supplied, and the source terminal and the back gate terminal being electrically connected to the discharging element;

a switch unit arranged in a current path between the discharging element and a ground node;

a detecting unit configured to detect a potential of the second node, and a control unit configured to set the switch unit to a conductive state based on a detection result from the detecting unit.

* * * * *